US005266431A

United States Patent [19]

Mammino et al.

[11] Patent Number: 5,266,431

[45] Date of Patent: Nov. 30, 1993

[54] ELECTROGRAPHIC IMAGING MEMBERS

[75] Inventors: Joseph Mammino, Penfield; Dennis Abramsohn, Pittsford, both of N.Y.

[73] Assignee: Xerox Corporation, Stamford, Conn.

[21] Appl. No.: 815,215

[22] Filed: Dec. 31, 1991

[51] Int. Cl.[5] ..... G03G 5/087

[52] U.S. Cl. ..... 430/96; 430/126

[58] Field of Search ..... 430/96, 126, 124

[56] References Cited

U.S. PATENT DOCUMENTS

| | | | |
|---|---|---|---|
| 3,888,667 | 6/1975 | Lee | 96/1.5 |
| 3,932,179 | 1/1976 | Perez-Albuerne | 96/1.5 |
| 4,199,626 | 4/1980 | Stryjewski et al. | 430/124 |
| 4,214,060 | 7/1980 | Apotheker et al. | 525/387 |
| 4,581,311 | 4/1986 | Kondo et al. | 430/80 |
| 4,588,667 | 5/1986 | Jones et al. | 430/73 |
| 4,766,190 | 8/1988 | Morita et al. | 525/360 |
| 4,803,140 | 2/1989 | Hiro | 430/58 |
| 4,822,122 | 4/1989 | Yamamoto et al. | 350/96.31 |
| 5,073,466 | 12/1991 | Ishikawa et al. | 430/96 |

*Primary Examiner*—John Goodrow

*Attorney, Agent, or Firm*—Kenyon & Kenyon

[57] ABSTRACT

An electrographic imaging member is disclosed which has a conductive substrate, a charge blocking layer, and an imaging layer comprising an elastomeric fluoropolymer.

16 Claims, 4 Drawing Sheets

ELECTROGRAPHIC IMAGING MEMBERS

BACKGROUND OF THE INVENTION

This invention relates to processes for preparing and using electrographic or ionographic imaging members, and particularly to imaging members comprising a conductive substrate, a charge blocking layer, and a dielectric imaging layer comprising an elastomeric fluoropolymer.

In electrography or ionography, an electrostatic latent image is formed on a dielectric imaging surface of an imaging layer (electroreceptor) by various techniques such as by ion stream (ionography), stylus, shaped electrode, and the like. Development of the electrostatic latent image may be effected by contacting the imaging surface with electrostatically attractable marking or toner particles whereby the particles deposit on the imaging surface in conformance to the latent image. The deposited particles may be transferred to a receiving member (such as paper) and the imaging surface may be cleaned and cycled through additional imaging and development cycles. These imaging and developing steps are well known in the art of electrography and are disclosed in many patents, such as U.S. Pat. Nos. 4,410,584, 4,463,363, 4,524,371, 4,644,373 and 4,584,592.

In addition, it is often important that electrostatographic imaging members be compatible with various imaging systems. Modern copiers and printers employ various development systems utilizing liquid or dry developers for producing color or black and white images. It is desirable to create an imaging member which will function in a many imaging systems as possible because not all existing imaging members function equally effectively in all environments. Ideally, an imaging member would be created to function equally effectively in liquid or dry developers and be useful in color or black or white copying systems.

Imaging members for electrography have been described. See, for example, U.S. Pat. No. 5,039,598, the disclosure of which is incorporated herein by reference. It has been found that imaging members in which the image receiving layer is made of a fluoroelastomer are particularly useful, especially in fabrication of flexible imaging members, such as continuous belt imaging members. However, in certain applications, particularly where an aluminum or aluminized conductive substrate is used, these imaging members exhibit some high charge injection effects from the substrate into the dielectric layer. This can result in non-capacitive charging causing high charge decay rates and low development potential. It would, therefore, be desirable to provide a fluoroelastomer-based imaging member in which these effects are minimized or eliminated.

SUMMARY OF THE INVENTION

It is, therefore, an object of the present invention to provide improved imaging members of fluoroelastomers and processes utilizing such fluoroelastomers which overcome at least some of the above-noted disadvantages.

It is another object of this invention to provide improved imaging members of fluoroelastomers which demonstrate low charge decay rates.

It is a further object of this invention to provide improved imaging members of fluoroelastomers which demonstrate essentially linear Q-V (charge v. voltage) charging.

It is yet another object of this invention to provide improved imaging members of fluoroelastomers which work well with liquid and dry developers.

It is still another object of the present invention to provide improved imaging members made of fluoroelastomers which work well with color or black and white image developing.

It is yet another object of the present invention to provide a fluoroelastomer-based imaging member having a blocking layer between the conductive substrate and the dielectric layer.

It is further object of the present invention to provide a fluoroelastomer-based imaging member having a layer between the conductive substrate and the dielectric layer which acts as both a blocking layer and an adhesive layer.

Some of the foregoing objects and others are accomplished in accordance with this invention by using an electrostatographic imaging member comprising a conductive substrate, a charge blocking layer, and an imaging layer comprising an elastomeric fluoropolymer. An electostatographic imaging member of this invention may be prepared by providing a substrate having an electrically conductive surface, applying a charge blocking layer on the substrate, and applying the fluoroelastomer polymer in accordance with known methods.

Most fluoroelastomer polymers which provide desirable dielectric characteristics in the resulting dielectric layer will be acceptable for use with the present invention. Suitable polymers include copolymers and terpolymers of vinylidene fluoride, hexafluoropropylene, tetrafluoroethylene, chlorotrifluoroethylene and propylene. Particularly preferred fluoroelastomer polymers include vinylidene fluoride/hexafluoropropylene copolymers and vinylidene fluoride/hexafluoropropylene/tetrafluoroethylene terpolymers (such as those sold by DuPont as Viton GF, Viton GFLT, Viton E-60C, Viton B-50, and other specialty materials available from DuPont including Viton VTR-5927, Viton 7000, Viton VTX 7055, Viton VTX 7056, Viton VTX 7048). Most preferred materials are Viton E-60C (a vinylidene fluoride/hexafluoropropylene copolymer), Viton GF (a vinylidene fluoride/hexafluoropropylene/tetrafluoroethylene terpolymer) and Viton B-50 (a vinylidene fluoride/hexafluoropropylene/tetrafluoroethylene terpolymer).

Suitable substrates are also known in the art. Preferred substrate materials include polyimides, poly(amideimides), polyetherether ketones, polyphenylene sulfides, and liquid crystal polymers, alone or in mixtures, which preferably withstand curing temperatures in excess of 200° C. Particularly preferred substrate materials include metalized polyimides (such as aluminized Kapton [a polyimide film available from DuPont], titanized Kapton and copperized Kapton), aluminum, nickel, copper and stainless steel. Alternatively, the substrate can be made of a polymer film filled with conductive materials such as carbon black, metal flakes or metal fibers, such as carbon black filled Kapton or Upilex (Upilex is a polyimide film available from ICI America).

The blocking layer can be made of any material which will retard or eliminate unwanted charge injection at the interface of the dielectric layer and substrate. Suitable blocking layers can be made from materials including polyepoxides, polyimides, poly(amideimides), polybenzimidazoles, polyquinoxalines and other polyheterocyclic polymers. Preferably, the material forming the blocking layer also has adhesive properties for bonding the dielectric layer to the substrate. Particularly preferred blocking layer materials include polyepoxides, polyimides and poly(amideimides) such as those sold under the following tradenames by the following companies: Matrimide 5292 and 5218 (polyimide resin) from Ciba-Geigy; Araldite 471×75 (cured with HY283 amide hardener), Araldite PT810, Araldite MY720, and Aralidte EPN 1138/1138 A-84 (multifunctional epoxy and epoxy novolac resins) from Ciba-Geigy; ECN 1235, 1273 and 1299 (epoxy cresol novolac resins) from Ciba-Geigy; Torlon AI-10 (poly(amideimide) resin) from Amoco; Thixon 300/301 from Whittaker Corp.; Tactix (tris(hydroxyphenyl) methane-based epoxy resins, oxazolidenone modified tris(hydroxyphenyl) methane-based epoxy resins, and multifunctional epoxy-based novolac resins) from Dow Chemical; and EYMYD resin L-20N (polyimide resin) from Ethyl Corporation, and the like.

The thickness of the dielectric image receiving layer, substrate layer and blocking layer will depend on numerous factors including the desired electrical characteristics of the layers and economic factors. Acceptable ranges for the thickness of the various layers are known to those skilled in the art. Suitable thicknesses for the substrate depend on its preferred usage as flexible or rigid. Typically flexible layers are from about 10 um (micrometers) to 250 um and rigid substrate layers from 250 um to about 5 mm. Blocking layer thicknesses are typically from about 0.01 um to about 12.5 um and are preferably from 1 um to 4 um. Dielectric layer thicknesses are typically from about 4 um to about 350 um and are preferably from 4 um to about 120 um.

The various layers may be applied to or united with underlying layers by using various methods known to those skilled in the art. These methods include without limitation spray coating, dip coating, roll coating, extrusion, molding and the like. The most preferred method is spray coating.

DETAILED DESCRIPTION OF PREFERRED EMBODIMENTS

Figure 1:
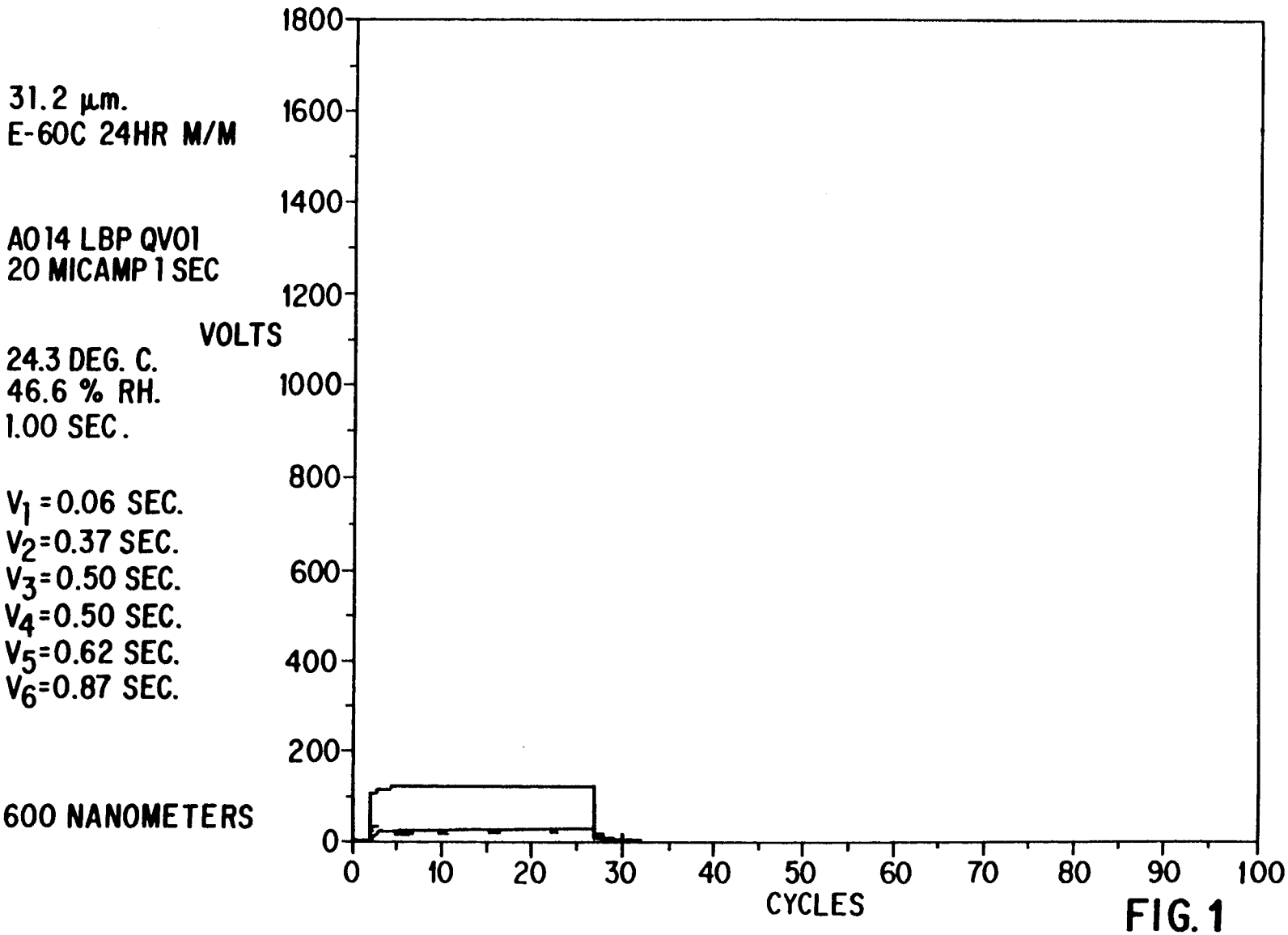
FIG. 1 shows a Q-V voltage versus charge cycle curve for the imaging member made in Example II below in which the sample was charged with 52 nanoamps per square centimeter each cycle for 25 cycles with erase between cycles.

The invention will now be described in detail with respect to specific preferred embodiments thereof, it being understood that these examples are intended to be illustrative only and that the invention is not intended to be limited to the materials, conditions, process parameters and the like recited herein.

The following experimental procedure was followed for testing each of the samples produced in the examples where indicated. Typical results from this procedure for certain examples are depicted in the Figures. Each sample was individually mounted on the outside surface of an aluminum drum about 3" in diameter. The drum and sample were rotated about one second per cycle under a 5 cm long corotron wire mounted with the wire parallel to the drum axis and controlled by a TREK model 610B to provide a continuous fixed charge current level. Thus, during each cycle, the sample was provided a fixed charge Q. Simultaneously, 6 non-contact voltage probes, such as TREK model 565 esv's, were mounted radially to the drum to measure the surface potential of the sample at various times after charging. This procedure provides a voltage versus charge cycle and/or voltage versus charge for each sample and thus provides the inverse Q-V (charge versus voltage) characteristics relevant to each sample's electrical performance.

EXAMPLE I 100 pph of Viton GF fluoroelastomer was mixed initially with 30 pph Carbon Black Thermax N990 and 15 pph Maglite-y (MgO) (available from Merck & Co., Inc.) on a rubber mill to uniformly disperse the ingredients. The sheet material that resulted from the mixture was cut into ½" thick, ½" by ½" squares to facilitate dissolution in a mixture of methyl ethyl ketone and methyl isobutyl ketone. The fluoroelastomer squares weighing a total of 98.0 grams were placed in a jar, solvated in 602 grams of 1:1 methyl ethyl ketone and methyl isobutyl ketone and 2.9 grams of Viton Curative #50, and roll milled overnight. Viton Curative #50 is a proprietary DuPont mixture of an organophosphonium salt and a dihydroxy aromatic compound.

The blocking layer was prepared by mixing an epoxy composition consisting of 25 grams of Thixon 300, 22.5 grams of Thixon 301, and 42.5 grams of methyl ethyl ketone together in a spray can container.

A Kapton metalized polyimide substrate film was mounted on a drum and held on a shaft of a Binks variable speed turntable. The blocking material was put into a spray gun with a pressurized spray pot and the material spray coated on to the substrate to a thickness between 5 um and 10 um. The blocking layer and substrate were then cured at 160° C. for 5 minutes. The fluoroelastomer charge receiver coating was then applied and cured for at least 24 hours at 200° C. and optimally cured for 1 week at 260° C.

EXAMPLE II

This sample was prepared as in Example I, except that a 31.2 micron thick sample of E-60C Viton, a copolymer of vinylidene fluoride and hexafluoropropylene, was coated on an aluminized Kapton substrate and no blocking layer was used. Viton E-60C, as obtained from DuPont, contains a proprietary mixture of curatives including #20, an organophosphonium salt, and

#30, a dihydroxy aromatic compound. The Q-V charge characteristics of this sample are represented in FIG. 1. This sample shows a very non-pinear charge acceptance and a high charge decay rate.

Figure 2:
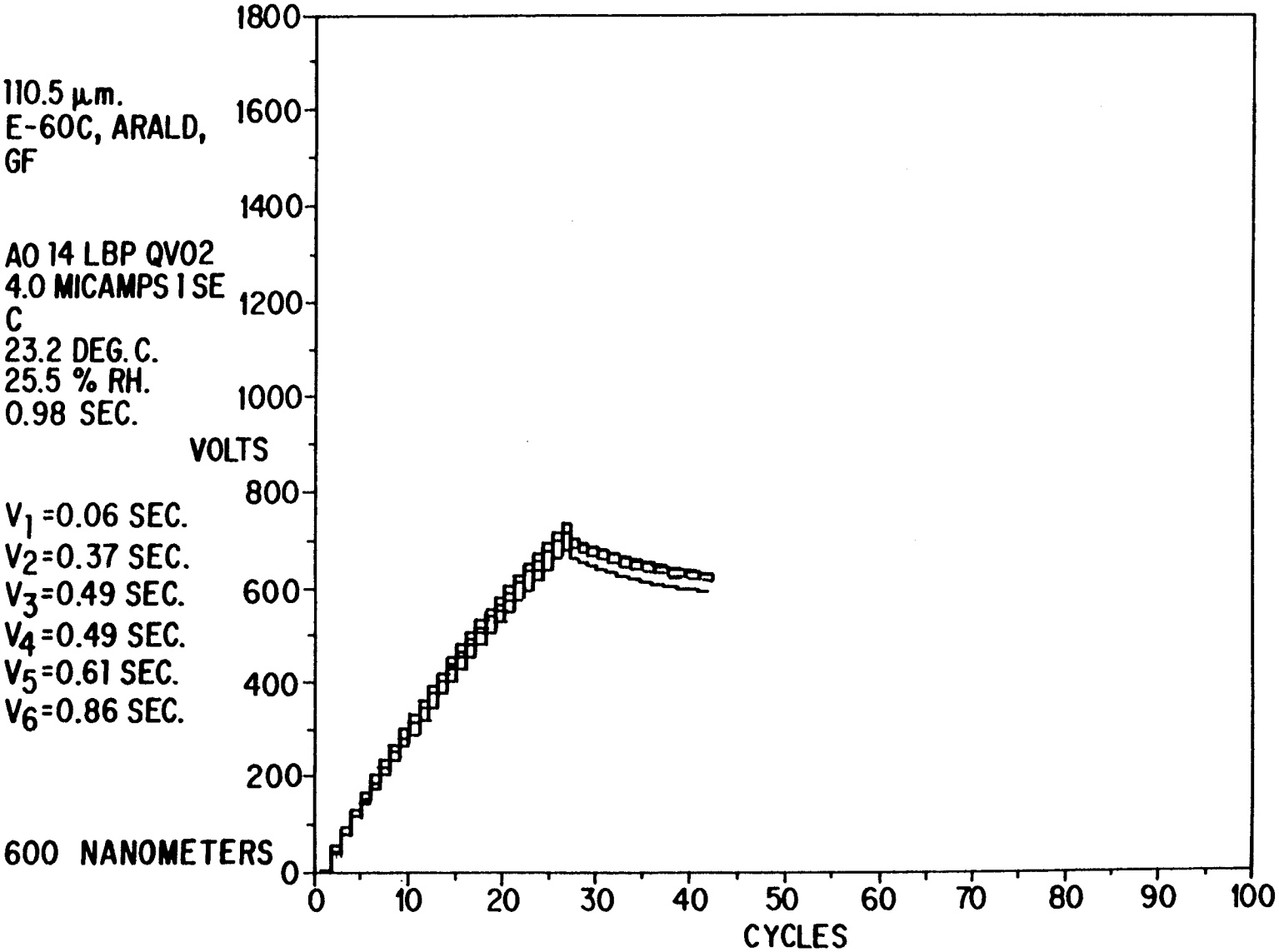
FIG. 2 shows a Q-V voltage versus charge cycle curve for the imaging member made in Example III below in which the sample was charged with 10 nanoamps per square centimeter each cycle for 25 cycles with no erase between cycles and allowed to decay for 15 cycles after the last charge cycle.

EXAMPLE III 800 g of Viton E-60C was compounded with 80 g of KETJENBlack EC conductive carbon black (available from Akzo Chemie America, Inc.), 24 g Maglite-D (MgO) and 48 g of $CA(OH)_2$ on a rubber mill to uniformly disperse the ingredients. The resulting sheet was cut into ⅛" thick, ½"× ½" squares. The fluoroelastomer compound above weighing 10 g was placed in a jar and solvated in 90 g of a 1:1 mixture of methylethyl ketone and methylisobutyl ketone. The solvated fluoroelastomer was spray coated on a non-metalized Kapton polyimide film to a dry thickness of about 50 um and cured for 24 hours at 200° C. The resistivity of the coating was about $10^3$ to $10^5$ ohms cm. A blocking layer was prepared by mixing a 1:1 weight ratio of Araldite GZ 471x-75 epoxy resin and hardener HY283, a polyamideamine crosslinking agent, (both available from Ciba-Geigy) in 360 g of methyl ethyl ketone and 240 g of toluene for a total blocking layer resin solids of 1.2 weight percent. The blocking layer was applied on top of the E-60C conductive compound and dried for 1 hour at 120° C. The blocking layer was about 3 um thick. The Viton GF fluoroelastomer coating of Example I was spray coated on the epoxy resin blocking layer above to a dry coating thickness of about 100 um and cured. The Q-V charge characteristics of this compound are represented in FIG. 2. This sample shows a nearly linear charge acceptance and a low charge decay rate.

EXAMPLE IV

Figure 3:
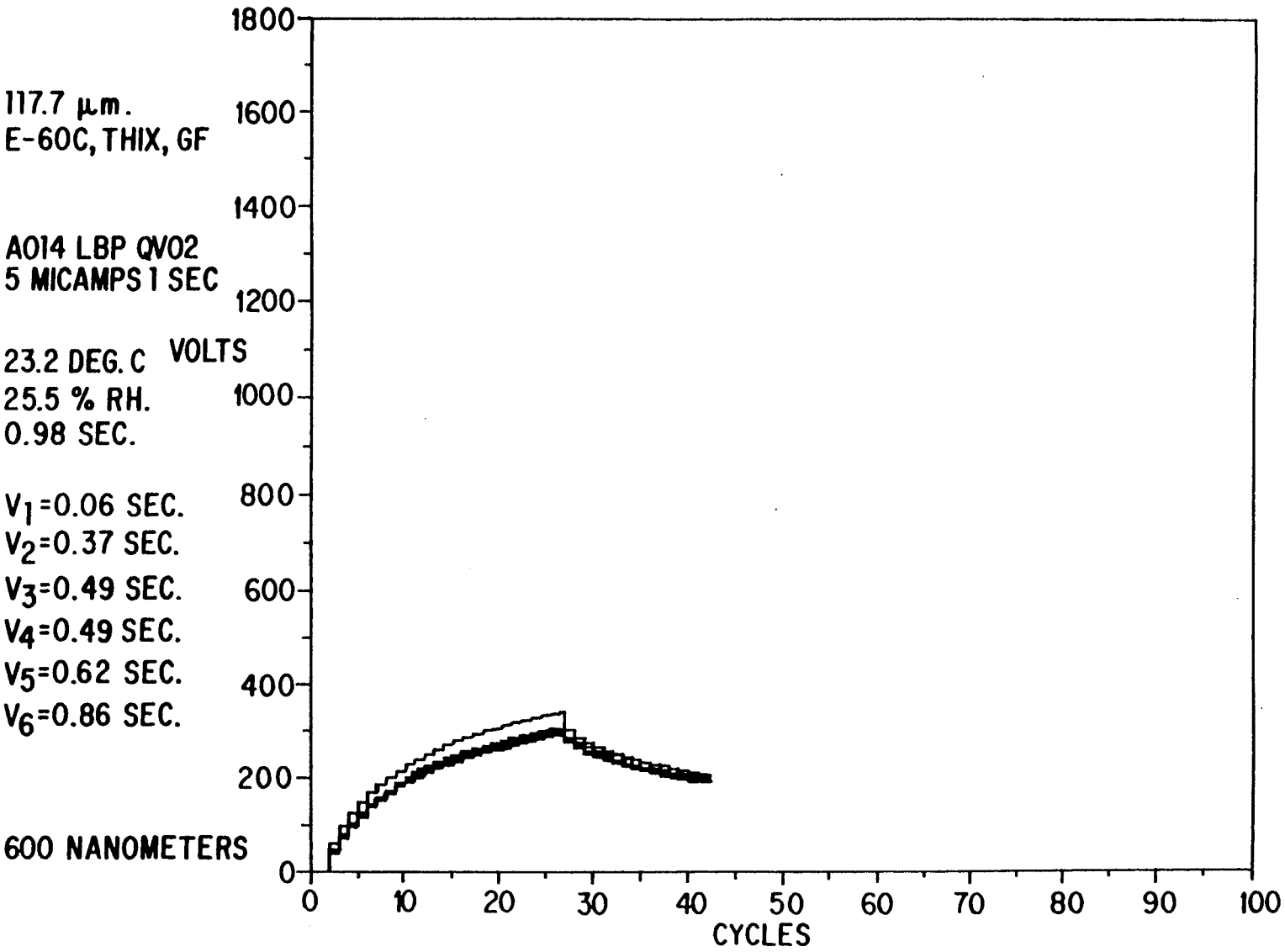
FIG. 3 shows a Q-V voltage versus charge cycle curve for the imaging member made in Example IV below in which the sample was charged with 12 nanoamps per square centimeter each cycle for 25 cycles with no erase between cycles and allowed to decay for 15 cycles after the last charge cycle.

This sample was prepared as in Example III, except that Viton GF was coated to a thickness of between 50 um and 100 um on an epoxy blocking layer composed of a mixture of Thixon 300 and 301 (at a thickness of about 5 um) which was coated on the carbon black filled Viton E-60C conductive layer. The Q-V charge characteristics of this compound are represented in FIG. 3. This sample shows a sublinear charge rate and a low to moderate charge decay rate.

EXAMPLE V

Figure 4:
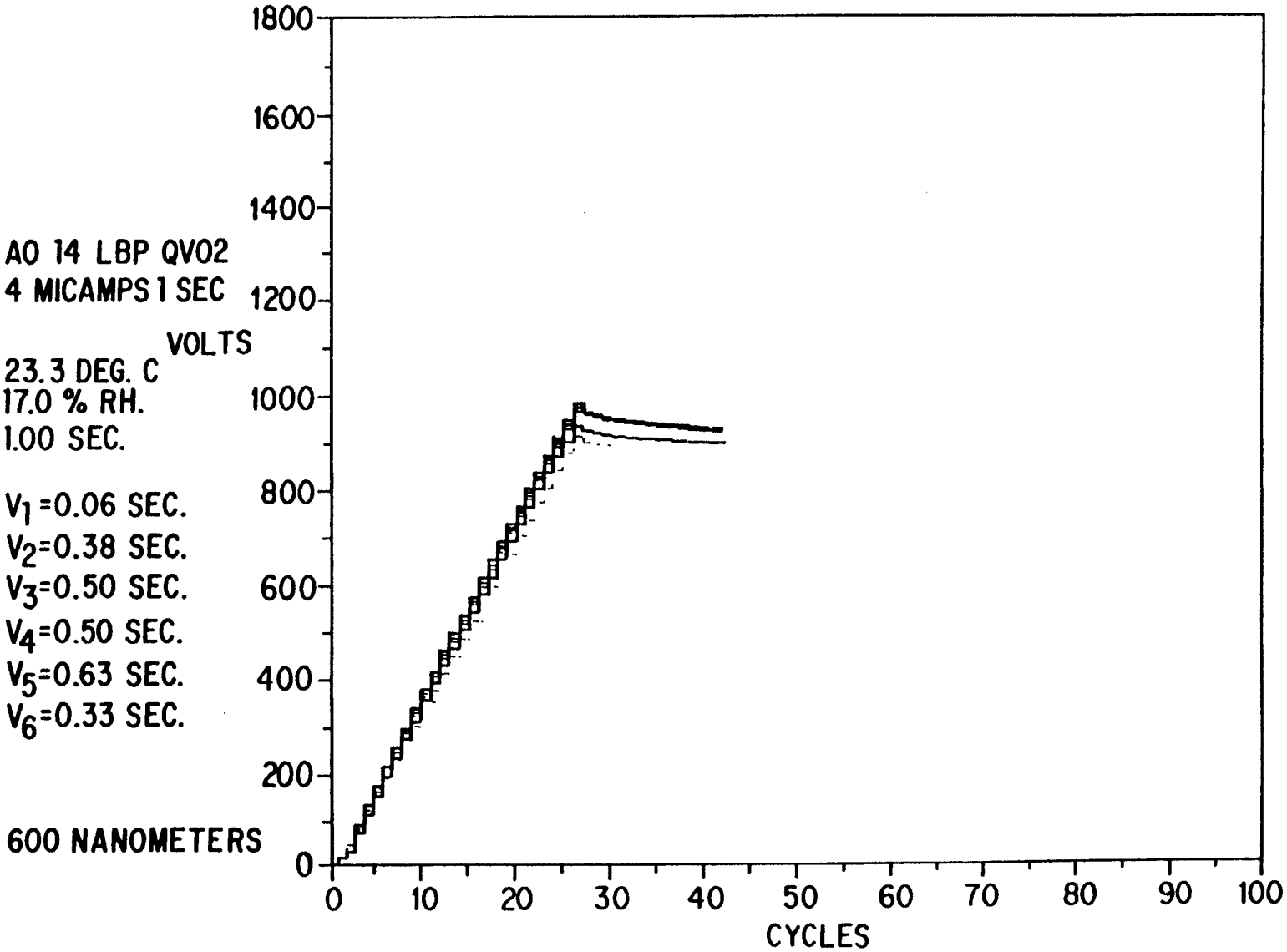
FIG. 4 shows a Q-V voltage versus charge cycle curve for the imaging member made in Example V below in which the sample was charged with 10 nanoamps per square centimeter each cycle for 25 cycles with no erase between cycles and allowed to decay for 15 cycles after the last charge cycle.

This sample was prepared as in Example I, except that Viton GF was coated to a thickness of 62.5 um on a 6 micron blocking layer composed of a mixture of Thixon 300 and 301 epoxy and applied to titanized Kapton polyimide film. The Q-V charge characteristics of this compound are represented in FIG. 4. This sample shows a very linear charge acceptance and an extremely low charge decay rate.

EXAMPLE VI

A fluoroelastomer terpolymer of vinylidene fluoride, hexafluoropropylene and tetrafluoroethylene (Viton B-50 available from DuPont) was compounded as described in Example I and solvated for spray coating. A sheet of 55 um thick stainless steel was degreased with methylene chloride and then spray coated with the epoxy blocking layer of Example III to a dry coating thickness of about 2 um. The fluoroelastomer compound above was spray coated on the epoxy blocking layer to a thickness of about 125 um, dried and cured for 24 hours at 200° C. The ends of the stainless steel sheet were welded together to form an endless belt of approximately 625 mm in circumference. Other blocking layer and fluoroelastomer coatings were prepared as described on stainless steel to be welded into endless belts of up to 2713 mm in circumference. These belts were put into ionographic fixtures to produce images which were developed by either liquid or dry xerographic developer.

EXAMPLE VII

This sample was prepared as described in Example VI except that a fluorinated polyimide coating (available as EYMYD L-20N from Ethyl Corporation) was used as the blocking layer at a thickness of about 4 um. The fluoroelastomer coating was about 150 um thick and cured for 24 hours at 200° C. The ionographic charge retention of the sample was very good, showing less than about 5 volts/second charge decay. The adhesion of the fluoroelastomer on the fluorinated polyimide blocking layer was excellent.

EXAMPLE VIII

This sample was prepared as described in Example VI except that the substrate was a sheet of polyimide film which was made bulk conductive through the addition of a carbon black filler throughout the film. The volume resistivity of the film was about $1\times10^6$ ohm-cm. The Q-V charge characteristics of this sample were similar to those shown in FIG. 4.

EXAMPLE IX

This sample was prepared as described in Example VIII except that the blocking layer was a poly(amideimide) resin (available as Torlon AI-10 from Amoco Chemicals Corp.) at a thickness of about 4 um. The adhesion of the fluoroelastomer to the substrate was excellent and the Q-V charge characteristics were similar to those of FIG. 4.

EXAMPLE X

An aluminum drum about 26.5 cm in diameter and about 42 cm in length was coated with a blocking layer and the fluoroelastomer charge receiver coating of Example V. The blocking layer thickness was about 3 um and the fluoroelastomer coating was about 125 um. The inonographic fluoroelastomer charge receiver coated drum was put into an imaging fixture which was equipped with a fluid jet assisted ion projection head typical of those described in U.S. Pat. No. 4,644,373. The type of ion projection head comprised an upper casting of stainless steel having a cavity. A pair of extensions on each side of the head formed wiping shoes which rode upon the outboard anodized edges of the aluminum drum to space the ion projection head about 760 um from the imaging surface of dielectric image layer. An exit channel including a cavity exit region was about 250 um (10 mils) long. A large area marking chip comprising a glass plate upon which was integrally fabricated thin film modulating electrodes, conductive traces and transistors was used for modulation of the ion stream at the exit channel. The width across the cavity was about 3175 um (125 mils) and a corona wire was spaced about 635 um (25 mils) from each of the cavity walls. A high potential source of about +3,600 volts was applied to the corona wire through a one megohm resistance element and a reference potential of about +1,200 volts was applied to the cavity wall. Control electrodes of an individually switchable thin film element layer (an array of 300 control electrodes per inch)

on the large area marking chip were each connected through standard multiplex circuitry to a voltage source of +1,220 volts or +1,230 volts, 10 to 20 volts above the reference potential. Each electrode controlled a narrow "beam" of ions in the curtain-like air stream that exited from an ion modulation region in the cavity adjacent the cavity exit region. The conductive electrodes were about 89 um (3.5 mils) wide each separated from the next by 38 um (1.5 mils). The distance between the thin film element layer and cavity wall at the closest point was about 75 um (3 mils). Laminar flow conditions prevailed at air flows of about 1.2 $ft^3$/minute. The metal drum of the tested sample was electrically grounded. In operation, the imaging surface on the electrographic drum was uniformly charged to about −1,500 volts at the charging station, imagewise discharged to −750 volts with the ion stream exiting from the fluid jet assisted projection head to form an electrostatic latent imaging having a difference in potential between background areas and the image areas of about 750 volts, and developed with a liquid developer composition biased at about −1,450 volts to develop an image of about 0.9 density units at about 300 lines per inch after transferring the image to paper. The fluoroelastomer charge receiver coating surface was cleaned and reimaged to produce several thousand prints. The image on the charge receiver was transferred to paper using a combination of pressure and electrostatic forces. The image was thermally fused to paper at a separate fusing station.

EXAMPLE XI

The fluoroelastomer ionographic charge receiver belt described in Example VI having a circumference of about 2713 mm was put into a fixture which was equipped with a belt drive and steering mechanism, four typical fluid assisted ion projection printing heads described in Example X, four liquid developer stations (one each for cyan, magenta, yellow, and black), a pair of heated pressure rolls and four cleaning stations. The ionographic charge receiver was imaged by one of the fluid assisted ion projection heads and the resulting charge pattern was developed with the appropriate color liquid developer. The excess liquid was blotted away by a sponge material at the cleaning station and the ionographic charge receiver with the first color image was imagewise charged by a second fluid assisted ion projection head corresponding to another color image. The process was repeated until a complete four color image was developed on the ionographic charge receiver. After the last color developer was developed and excess liquid carrier fluid was blotted away, the image was passed between a pair of heated pressure rollers together with a sheet of paper of effectively transfer and fuse the image on the charge receiver to paper. The pressure applied was about 800 to 1000 lbs. per inch and the rolls were heated to about 450°-500° F. Image transfer and fusing on the paper was substantially complete and essentially no cleaning of the charge receiver was required. Several hundred prints were made in this manner.

We claim:

1. An electrographic imaging member comprising a conductive substrate, a charge blocking layer overlying the substrate, and a dielectric imaging layer overlying the blocking layer, wherein the dielectric imaging layer comprises and elastomeric fluoropolymer.

2. An electrographic imaging member according to claim 1 wherein the conductive substrate is made of a material selected from the group consisting of metalized polyimides, metalized poly(amideimides), metalized polyetherether keytones, metalized polyphenylene sulfides, conductive elastomeric fluoropolymers, stainless steel, nickel, aluminum, and copper.

3. An electrographic imaging member according to claim 1 wherein the conductive substrate is made of a polymer material filled with a conductive material.

4. An electrographic imaging member according to claim 3 wherein the conductive substrate is made of a polyimide filled with carbon black particles.

5. An electrographic imaging member according to claim 1 wherein the blocking layer is made of a material selected from the group consisting of epoxies, polyimides and poly(amideimides).

6. An electrographic imaging member according to claim 1 wherein the elastomeric fluoropolymer is a copolymer or terpolymer of one or more materials selected from the group consisting of vinylidene fluoride, hexafluoropropylene, tetrafluoroethylene, chlorotrifluoroethylene and propylene.

7. An electrographic imaging member according to claim 6 wherein the elastomeric fluoropolymer is a copolymer of vinylidene fluoride and hexafluoropropylene.

8. An electrographic imaging member according to claim 6 wherein the elastomeric fluoropolymer is a terpolymer of vinylidene fluoride, hexafluoropropylene and tetrafluoroethylene.

9. An electrographic imaging member according to claim 2 wherein the substrate is titanized polyimide.

10. An electrographic imaging member according to claim 2 wherein the substrate is aluminized polyimide.

11. An electrographic imaging member according to claim 5 wherein the blocking layer is an epoxy compound.

12. An electrographic imaging member according to claim 2 wherein the substrate is stainless steel.

13. An electrographic imaging member according to claim 2 wherein the substrate is a conductive elastomeric fluoropolymer.

14. An electrographic imaging member according to claim 1 wherein the imaging member is in a form selected from the group consisting of a drum, a belt and a sheet.

15. An electrographic imaging process comprising:

(a) providing an electrographic imaging member according to claim 1;

(b) forming a latent image on the imaging member;

(c) developing the latent image; and (d) transferring the developed image to an image receiving substrate.

16. A process according to claim 15 wherein the developed image is transferred by heat and pressure.

* * * * *

UNITED STATES PATENT AND TRADEMARK OFFICE

CERTIFICATE OF CORRECTION

PATENT NO. : 5,266,431

DATED : 30 November 1993

INVENTOR(S) : Joseph MAMMINO et al.

It is certified that error appears in the above-indentified patent and that said Letters Patent is hereby corrected as shown below:

| Column | Line | |
|---|---|---|
| 1 | 35 | Change "a" to --as--. |
| 4 | 37 | Change "1/2" thick" to --1/8" thick--. |
| 7 | 54 | After "paper" change "of" to --to--. |
| 8 | 5 | Change "and" to --an--. |
| 8 | 10 | Change "keytones" to --ketones--. |

Signed and Sealed this

Thirty-first Day of May, 1994

Bruce Lehman

*Attest:*

BRUCE LEHMAN

*Attesting Officer*

*Commissioner of Patents and Trademarks*